United States Patent [19]

Robertson

[11] Patent Number: 4,879,876

[45] Date of Patent: Nov. 14, 1989

[54] CRYOGENIC REFRIGERATION APPARATUS

[76] Inventor: Warren A. Robertson, 8021 Floral View Way, Port Richey, Fla. 34668

[21] Appl. No.: 305,569

[22] Filed: Feb. 3, 1989

[51] Int. Cl.[4] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,188,821 | 6/1965 | Chellis et al. | 62/6 |
| 4,389,849 | 6/1983 | Gasser et al. | 62/6 |
| 4,417,448 | 11/1983 | Horn et al. | 62/6 |
| 4,526,008 | 7/1985 | Taylor, Sr. | 62/6 |
| 4,534,176 | 8/1985 | Horn et al. | 62/6 |
| 4,543,793 | 10/1985 | Chellis et al. | 62/6 |
| 4,545,209 | 10/1985 | Young | 62/6 |
| 4,724,676 | 2/1988 | Lewis | 62/6 |

*Primary Examiner*—Ronald C. Capossela
*Attorney, Agent, or Firm*—Stanley M. Miller

[57] ABSTRACT

A cryogenic refrigeration apparatus that re-liquifies boiled off cryogenic gases and returns the cooled, re-liquified gases to the cryogenic load. Reciprocation of a driver piston effects simultaneous and corresponding reciprocation of compressor and expander pistons. A magnetic sensor senses the position of the driver piston when at its top dead center position, its bottom dead center position, and a position about half way therebetween. Signals corresponding to the sensed position of the driver piston are sent to a logic control unit that governs the opening and closing of valves throughout the apparatus.

20 Claims, 5 Drawing Sheets

CRYOGENIC REFRIGERATION APPARATUS

BACKGROUND OF THE INVENTION

1. Field of the Invention

This invention relates to a cryogenic refrigeration apparatus. More particularly, it relates to a refrigeration apparatus that re-liquifies boiled off cryogenic gases.

2. Description of the Prior Art

The present inventor is aware of U.S. patents to Chellis, et al., No. (4,543,793), to Horn, et al. No. (4,417,448), to Young No. (4,545,209) and to Chellis No. (3,188,821); all of these patents show cryogenic or low temperature refrigeration systems. Other pertinent disclosures have been made by Gasser, et al. No. (4,389,849) and Taylor, Sr. No. (4,526,008).

Although the earlier devices perform their intended functions in an adequate manner, they provide inadequate means for re-liquifying boiled off cryogenic gases.

The prior art apparatuses are also not built for longevity.

Accordingly, there is a need for a cryogenic refrigeration apparatus that has an improved means for re-liquifying boiled off gases and that is built to have a long life.

SUMMARY OF THE INVENTION

The longstanding but heretofore unfulfilled need for a cryogenic refrigeration apparatus having increased reliability and efficiency is now fulfilled by the present invention.

The reciprocation of compressor and expander pistons is enhanced by an improvement to the inner cylindrical walls of the respective cylinders within which the pistons reciprocate. Specifically, the cylinder walls are machined and polished to have a finish between ten to twenty microinches.

The pistons are yoked together by a driver piston; the driver piston is driven by a small, motor-driven external compressor. The instantaneous position of the driver piston and hence of the compressor and expander pistons is sensed as it reciprocates by a plurality of sensor means or switches. Valves that interconnect the compressor and expander to heat exchangers are opened and closed by a logic control unit dependent upon the sensed position.

The heat exchangers are of the counter flow type; bypass valves, cooldown valves, and Joules-Thompson valves are provided to maximize the efficiency of the unit.

The primary object of this invention is to provide a highly efficient means for re-liquifying boiled off cryogenic gases and returning the cooled, re-liquified gases to the cryogenic load.

It is another object of this invention to provide a cryogenic refrigeration apparatus that needs infrequent overhauling.

Another object is to provide a means whereby the position of a piston in a cryogenic refrigeration apparatus may be sensed so that valves may be opened and closed in a predetermined manner dependent upon the position of the piston that is sensed.

Numerous other objects of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
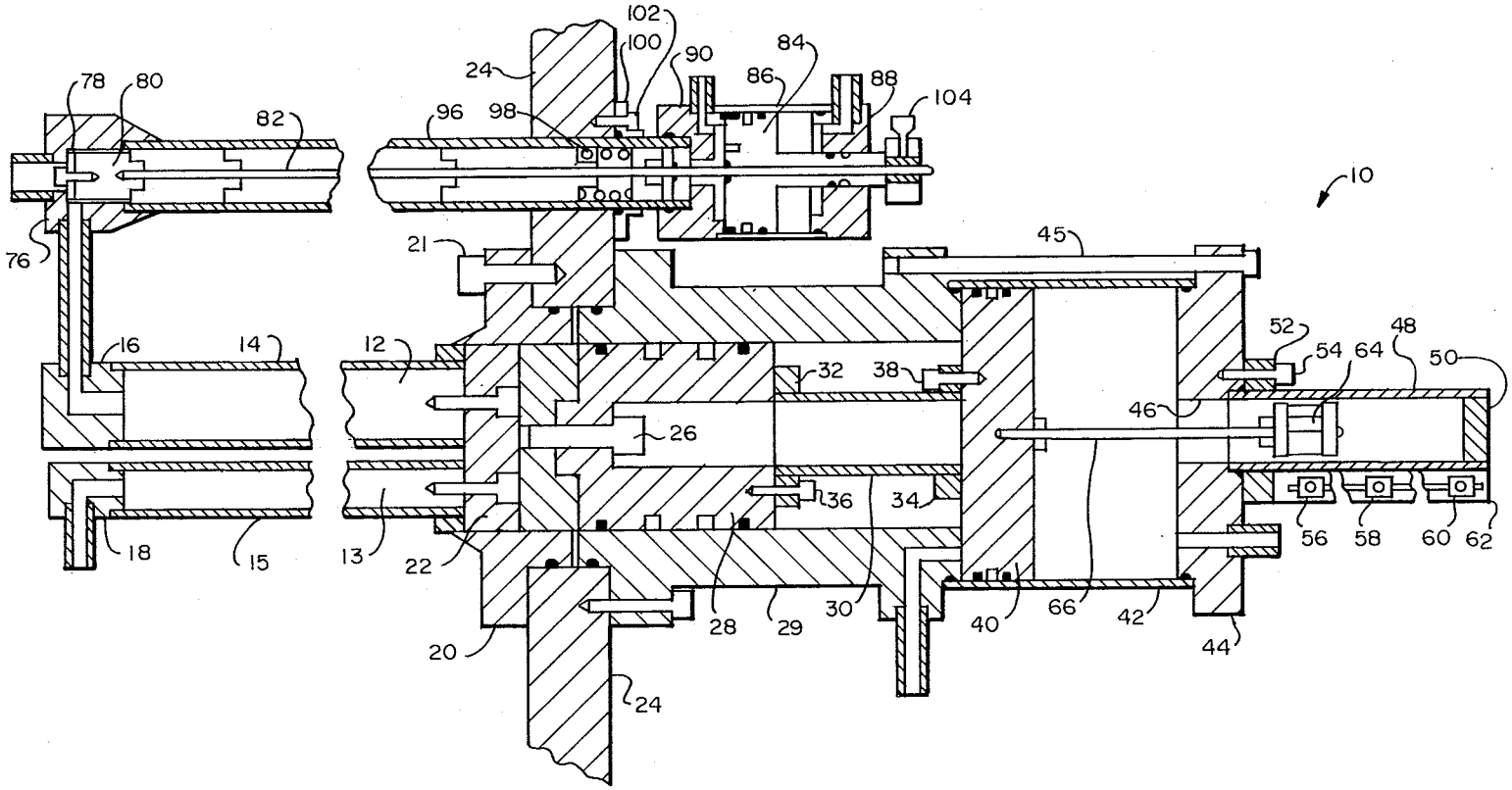
FIG. 1 is a longitudinal sectional view of the compressor and expander pistons of this invention, and other closely related parts.

Referring now to FIG. 1, it will there be seen that important structural details of the novel compressor and expander pistons are denoted as a whole by the reference numeral 10.

Apparatus 10 includes compressor piston 12 slideably received within compressor cylinder 14 and expandor piston 13 which is slideably received within expander cylinder 15.

As shown in FIG. 1, pistons 12 and 13 are in their respective bottom dead center (BDC) positions, i.e., the clearance space between the cylinder end caps 16 and 18 and the heads of the respective pistons 12 and 13 is at its minimum.

An annular flange 20 at the opposite or top end of the cylinders 14 and 15 is secured by circumferentially spaced bolts 21, only one of which is shown, to a main flange member 24. The compressor and expander cylinders 14, 15 are yoked together at their top ends as shown by a plate member 22. Accordingly, cylinders 14 and 15 are stationary as pistons 12 and 13 reciprocate in the manner hereinafter described.

Bolt 26 joins plate 22 to a seal and lubricator carrier 28 which is slideably mounted for reciprocation in guide cylinder 29. A rigid coupling member 30 is flanged at both ends as at 32, 34 and plural circumferentially spaced bolts, represented by bolts 36, 38, respectively, secure the coupler 30 in interconnecting relation to the seal and lubricator carrier 28 and driver piston 40.

Driver piston 40 is reciprocably mounted in driver piston cylinder 42 which terminates in driver piston cylinder head 44 as shown; plural elongate bolts such as bolt 45 secure cylinder head 44 to the guide cylinder 29.

Cylinder head 44 is centrally apertured as at 46 and a position cylinder 48 is in open communication with central aperture 46 as shown; position cylinder 48 is capped by end cap member 50. Position cylinder 48 is flanged as at 52 for abutting engagement with cylinder head 44 by circumferentially spaced plural bolt members represented by bolt member 54.

Three magnetically activated switch members, denoted 56, 58 and 60 are mounted in an adjustable mounting plate 62 that is contiguous to position cylinder 48 as shown. A magnet member 64 that activates a switch 56, 58 or 60 when it is in close juxtaposition thereto is carried at the distal free end of a magnet support rod 66 which is secured by suitable means to driver piston 40. Accordingly, reciprocation of driver piston 40 effects simultaneous and corresponding reciprocation of magnet member 64.

It should be understood that reciprocation of driver piston 40 effects simultaneous and corresponding reciprocation of compresser and expander pistons 12, 13. Reciprocation of driver piston 40 is effected by the flow of cryogenic fluid (neon, hydrogen or helium, or other suitable fluids) through ports 1 and 2; the flow of cryogenic fluid through the entire novel system as hereinafter explained is controlled by a pair of solenoid valves which are in turn under the control of a logic control unit, shown in FIGS. 2–4, that receives its input information from switches or position sensors 56, 58, 60. A small motor-driven external compressor, shown in FIGS. 2–5, provides the motive force behind the refrigerant fluid.

Another pair of ports is denoted 3, 4 and appears at the left side of FIG. 1. Ports 3 and 4 open and close under the control of the logic control unit.

Ports 3 and 4 control the opening and closing of port 5 which appears at the bottom left of FIG. 1. Port 5 is an exhaust port that allows refrigerant fluid to flow to a predetermined section of a second heat exchanger as will be more fully set forth in connection with the description of FIG. 5.

An identical set of ports 3 and 4 are disposed adjacent the illustrated third and fourth ports but are not shown in FIG. 1 to simplify the drawing. The unillustrated ports control a port that serves as the inlet port to the compressor cylinder from an outlet of the first heat exchanger as will be explained in connection with FIGS. 2–4.

FIG. 1 also deletes two more identical sets of ports that would appear on the right side of FIG. 1 if it were not so simplified. All of the ports deleted from FIG. 1 are shown in diagrammatic form in FIGS. 2–4. Thus, it should be understood that FIG. 1 merely depicts certain important structural details of the novel system, but due to the complexity of the detals and the fact that the other parts of the invention are built in the same way, only a fraction of the total parts are shown in FIG. 1.

The manner in which the parts of FIG. 1 are incorporated into the entire novel system will become clear as this description proceeds.

Referring now to the lower left corner of FIG. 1, it will there be seen that valve body 76 slideably receives process valve seal 78 which is carried by seal carrier 80 to which is fixedly secured elongate process valve stem 82 as shown. When valve stem 82 is reciprocated along its longitudinal axis of symmetry in the manner hereinafter described, port 5 opens and closes.

Elongate valve stem 82 is reciprocated by a valve operator piston, denoted 84, shown to the left of the middle of FIG. 1. Valve operator piston 84 is mounted for reciprocal movement within cylinder 86 which has top end cap 88 and bottom end cap 90. Ports 3 and 4 are formed in caps 88 and 90, respectively. Refrigerant fluid circulated by the small external compressor is introduced into ports 3 and 4 when they are opened by the logic control unit which receives its input information from position switches 56, 58 and 60 as mentioned earlier.

Elongate valve stem 82 is disposed in an elongate sleeve member 96 and is separated therefrom by plural insulated spacers 98. Sleeve member 96 extends through suitably apertured main flange member 24 and has its oppposite ends fixedly secured to bottom end cap 90 of valve cylinder 86 and to process valve body 76, respectively, all as shown. A spring or other suitable bias means 98 returns process valve seal 78 to its FIG. 1 position periodically as the novel system operates.

Process valve sleeve member 96 is held against movement by flange 100 and bolts 102, only one of which is shown, which secure said sleeve to the main flange 24. The initial position of valve stem 82 and hence process valve seal 78 is adjustable through set screw 104 shown at the top of the process valve assembly.

Having described the physical construction of a part of the inventive components, a larger part of the overall system can now be examined while keeping in mind that the parts thereof not depicted in FIG. 1 are constructed in the same manner.

Figure 2:
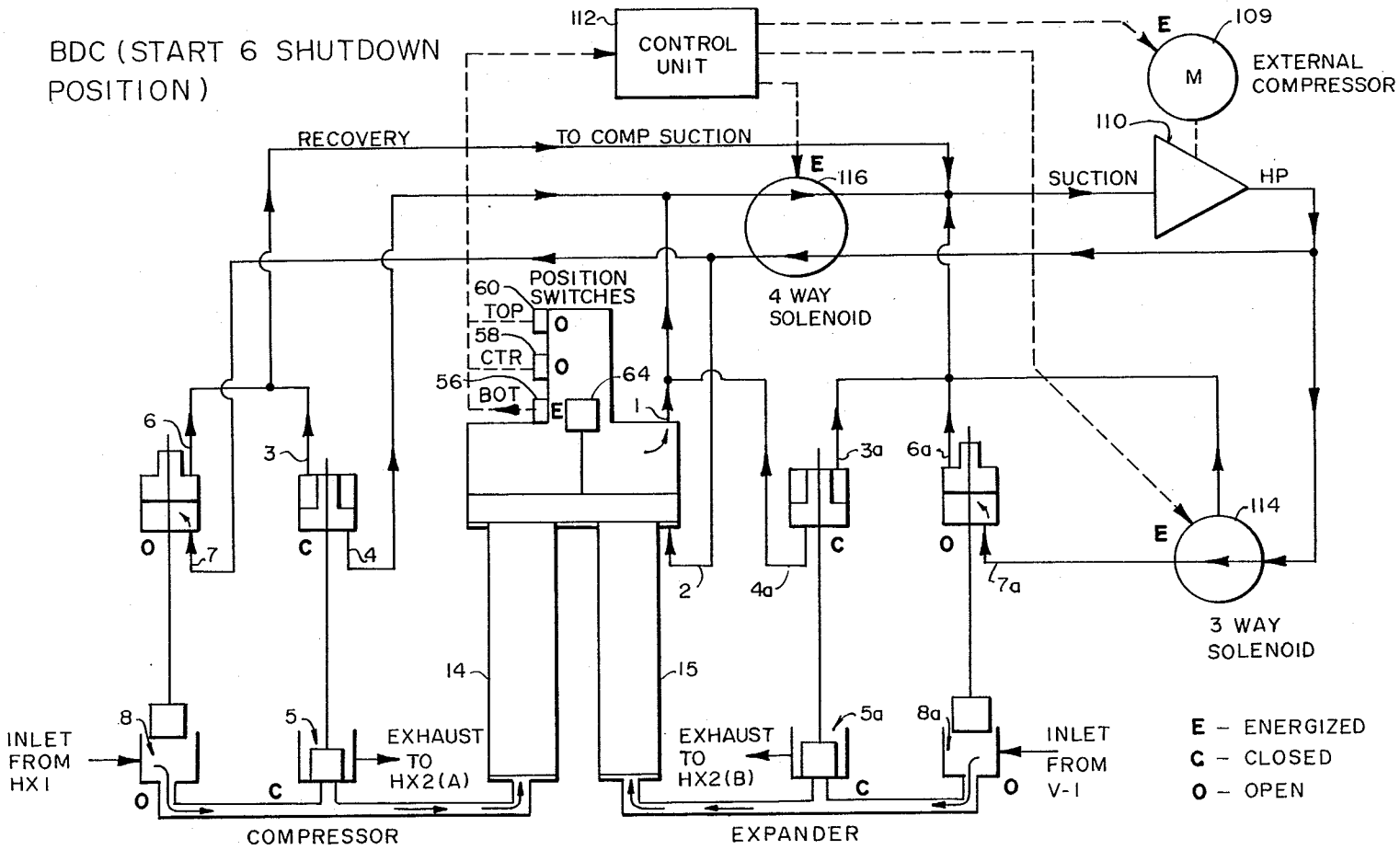
FIG. 2 is a schematic diagram showing the valve openings and refrigerant fluid flow within the novel system when the compressor and expander pistons are in their common bottom dead center position.

The initial position of most of the system is as depicted in FIG. 2. All of the FIG. 1 parts are shown diagrammatically in FIG. 2, but due to the complexity of the system the counter flow heat exchangers and other very important parts are omitted therefrom and are shown instead in FIG. 5. Attention, for now, however, will be restricted to FIGS. 2–4 which show the beginning, middle and end of a single reciprocation of the cryogenic pistons, respectively. The initial position of the movable parts of the system, as depicted in FIG. 2, is automatically attained in the event of normal shut down, a power failure or other loss of control power.

The system is activated by starting motor 109 that drives external compressor 110 and by energizing the control circuits, both of which are accomplished by activation of a switch means, not shown.

When magnet 64 is in its FIG. 2 position, (its BDC position, just as depicted in FIG. 1), switch 56 sends an input signal to the logic control unit 112; as indicated in the broken lines of FIG. 2, unit 112 energizes three way solenoid valve 114 and four way solenoid valve 116. Cryogenic fluid then flows throughout the entire system as directed by the solenoid valves 114 and 116; the direction of flow of the fluid is depicted in FIG. 2 by directional arrows congruent with the lines that interconnect the various parts of the invention as shown.

Figure 3:
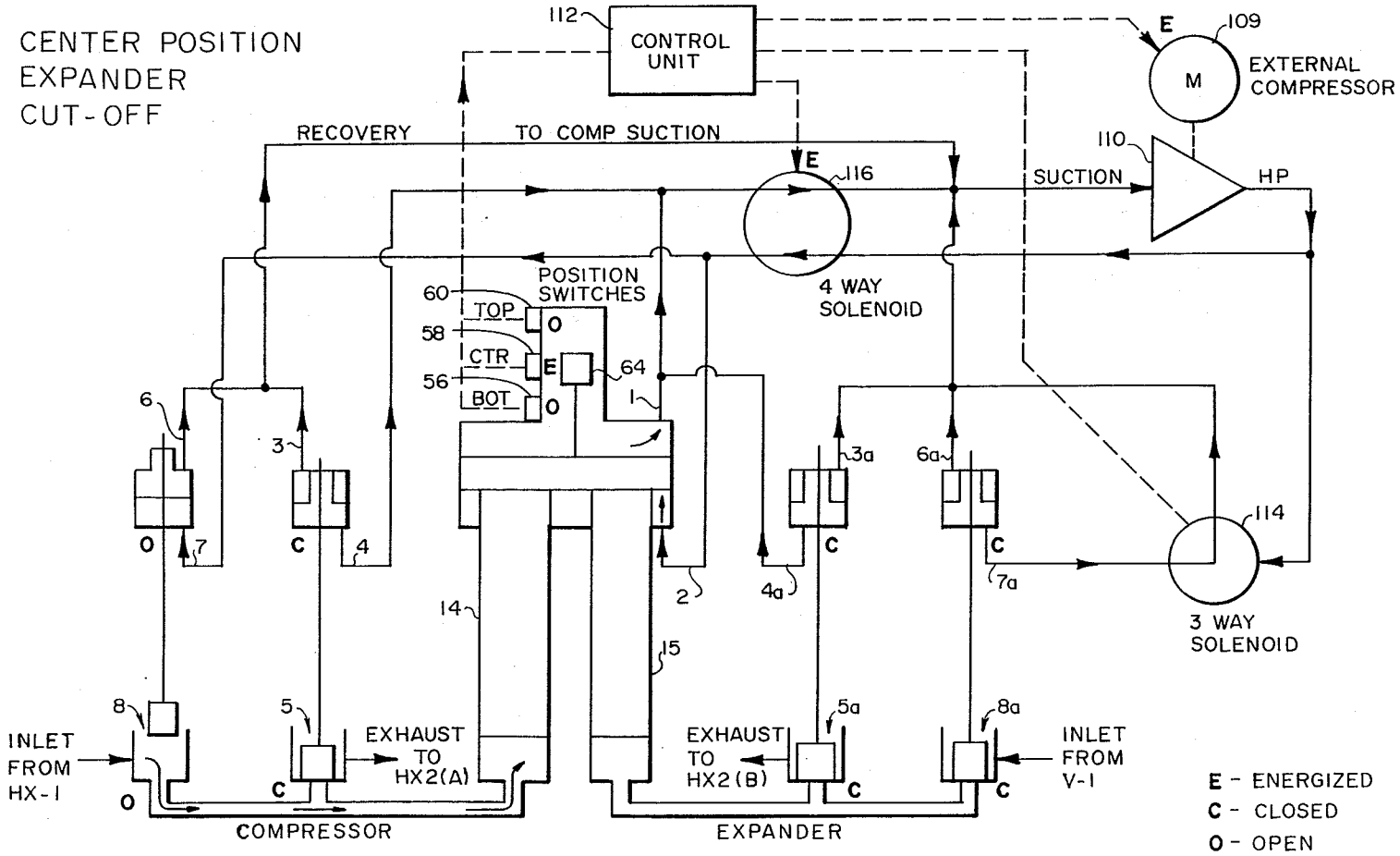
FIG. 3 is a schematic diagram showing the valve openings and refrigerant fluid flow when the cryogenic pistons have moved forty percent (40%) of the way toward their common top dead center position.
Figure 4:
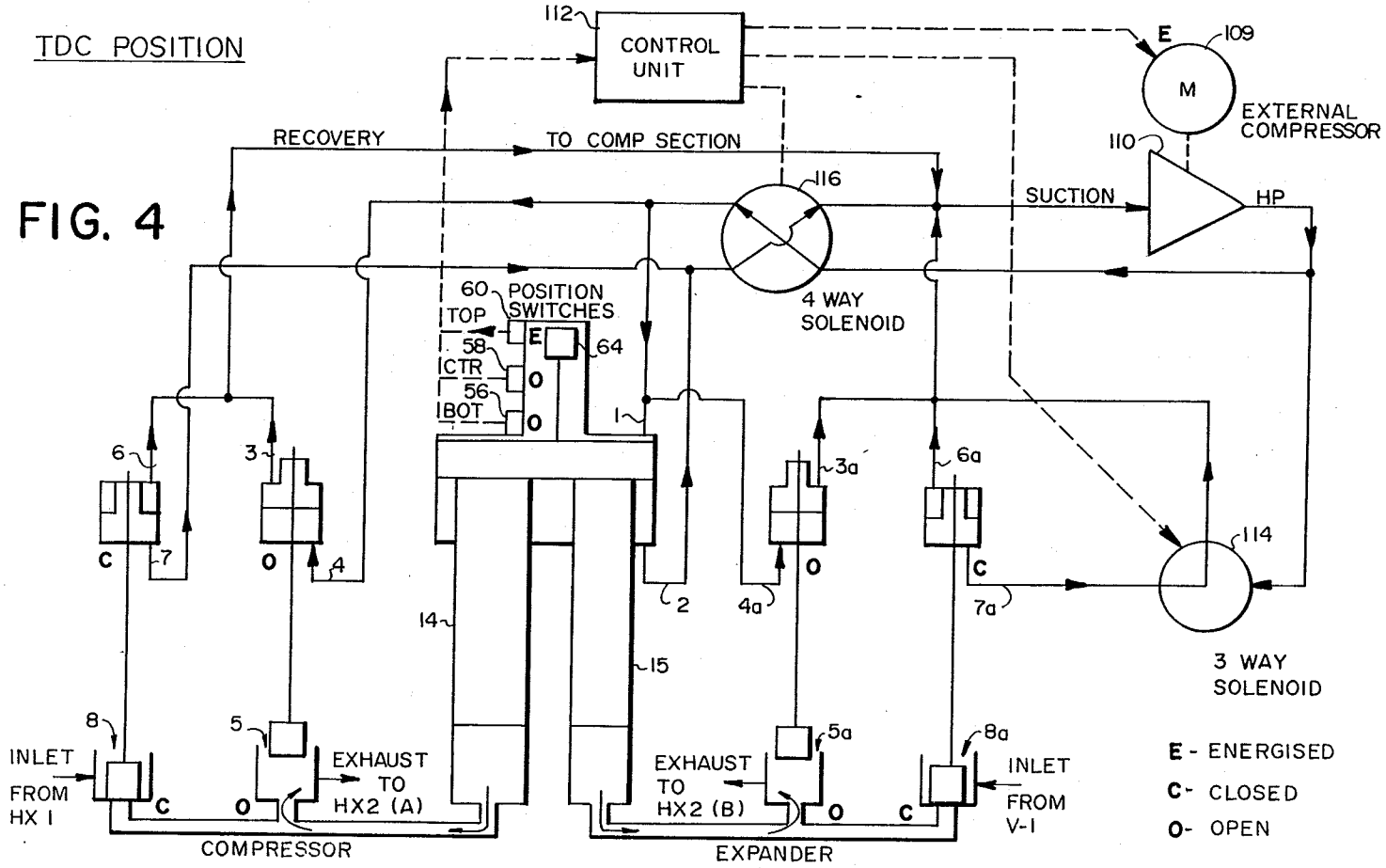
FIG. 4 is a schematic diagram showing the valve openings and cryogenic flow when the pistons are in their common top dead center position.

In order to better understand how FIGS. 2–4 relate to FIG. 1, it should be noted that ports 1, 2, 3, 4 and 5, which are the only ports depicted in FIG. 1, are also shown in FIGS. 2–4. Additional ports 6, 7 and 8 are shown, and, as aforesaid, they have the same detailed construction as ports 3, 4 and 5 as set forth in FIG. 1. Ports 6 and 7 control the opening and closing of port 8 in the same way as port 5 is controlled by ports 3 and 4.

Ports 3–8 are associated with the compressor side of the apparatus, as is clear from FIGS. 2–4. Their corresponding ports on the expander side of the system are denoted **3*a*, 4*a*, 5*a*, 6*a*, 7*a* and 8*a*, respectively. The expander-associated ports 3*a*–8*a* are also constructed in the same manner as ports 3–5 of FIG. 1**.

FIG. 2 indicates the open or closed position of each port 3–8 and **3*a*–8*a*** when the cryogenic cylinders are in their common bottom dead center position. Cryogenic fluid under pressure from the small external compressor is beginning to displace the driver piston from its bottom dead center position and the compressor and expander pistons are beginning to travel upwardly, drawing the gasous cryogenic fluid as indicated by the directional arrows in the conduits interconnecting the ports and their associated pistons.

Reference should now be made to FIG. 3; the pistons have now completed forty percent (40%) of their respective strokes and magnet member 64 has activated switch 58. Compressor ports 5 and 8 and expander port 5a remain in their FIG. 2 positions but expander port 8a has now closed. The expander piston 15 will continue to travel toward its top dead center position, but since port 8a has closed, the gases in the expander cylinder will expand and cool, as is desired.

Ports 5 and 5a open for the first time when the pistons reach their TDC position as shown in FIG. 4. Compressor inlet port 8 closes for the first time and expander inlet port 8a remains closed. Ports 5 and 5a exhaust the cryogenic fluid to different sections of the second heat exchanger, as set forth more fully in connection with FIG. 5, to which FIG. reference is now made.

As mentioned earlier, the cryogenic fluid entering the novel system is in gasous form; such fluid is the boiled off gases from a load such as a superconducting magnet or other experimental load. The incoming boiled off gases enter the novel system at the inlet 120 and flow either into the first heat exchanger 122 or through valve 103 to the driver piston 40.

Gases entering the first heat exchanger 122 pass therethrough and subsequently enter the compressor inlet valve 8 as shown. When the start button is energized, the compressor inlet port 8 opens and the gas is pumped into the compressor cylinder by the piston until the top switch is activated by the magnet. When the top switch is activated (FIG. 4), port 8 closes, exhaust port 5 opens, and the compressor piston is driven down by the driver piston.

Figure 5:
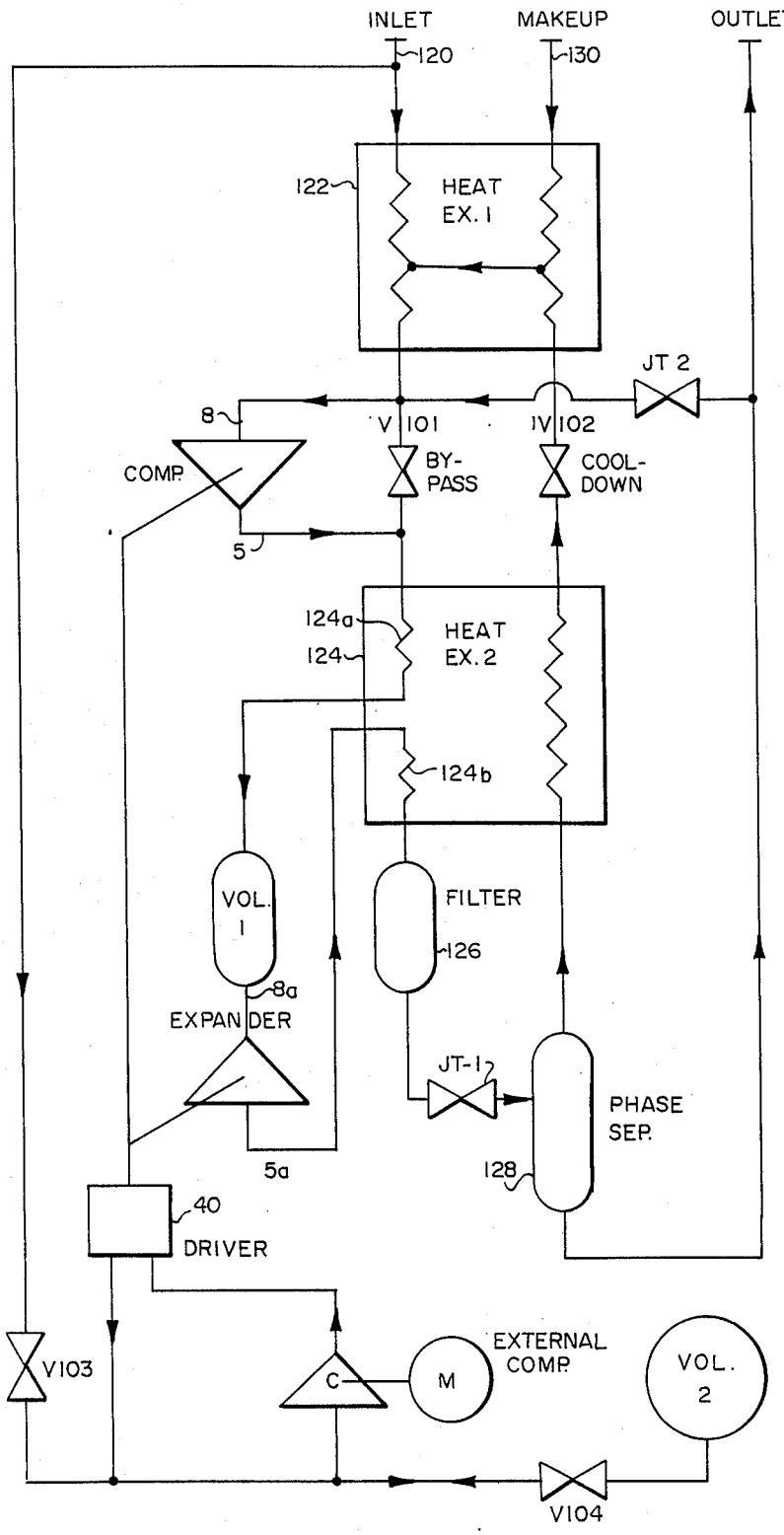
FIG. 5 is a diagram showing the counter flow heat exchangers, phase separator and other important components not shown in FIGS. 1–4.

The gas is then pumped by the cryogenic compressor through port 5 into the upper section 124a of second heat exchanger 124 and also into the storage volume denoted Vol. 1 in FIG. 5.

Vol. 1 is confluent with the inlet port 8a of the expander piston. When the BDC is again reached, expander inlet port 8a opens, and gas is admitted into the expander cylinder until port 8a is again closed when the forty percent travel switch is activated. As aforesaid, the expander piston will continue to travel toward its TDC position and the corresponding increase in volume and decrease in pressure will result in cooling of the gas. When the TDC position is reached, the expander exhaust port 5a opens and the expander piston is driven back to its BDC position by the driver piston. The cooled gas is driven into the lower section 124b of the second heat exchanger 124, passes through a cryogenic filter 126 and from thence to a Joules Thompson valve denoted JT 1 where the final expansion and cooling takes place.

The resulting liquid and gas are then delivered to phase separator 128 where liquid settles to the bottom, of course, and the gases rise to the top. The gases are recirculated back to the cryogenic compressor as shown in FIG. 5 to cool the incoming inlet stream through the second heat exchanger and the lower section of the first heat exchanger as controlled by cooldown valve V102.

The liquid phase taken from the bottom of the phase separator is delivered to a storage tank or experiment by the pressure differential within the cryogenic compressor/expander unit.

A small controlled bleed, via valve means JT 2, from the liquid phase is used to provide additional cooling to the incoming cryogen at the cycrogenic compressor inlet 8. The first heat exchanger has provision for injecting make up gas as at 130 which is used for the initial cooldown of the cryogenic compressor/expander unit. A compressor bypass valve V101 is positioned as shown in FIG. 5 to provide a rapid cooldown path from the inlet port 120 when startup is made with a cold storage tank and no makeup gas.

In this manner, the art of cryogenic refrigeration devices is appreciably advanced.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A cryogenic refrigeration apparatus, comprising:

a compressor piston and cylinder;

an expander piston and cylinder;

a driver piston and cylinder that yokes together said compressor and expander pistons;

a position cylinder;

a first, second and third switch means positioned in specifically predetermined respective positions along the longitudinal extent of said position cylinder;

a magnet means slideably disposed within said position cylinder;

an elongate rod means interconnecting said magnet means and said driver piston so that reciprocation of said driver piston effects simultaneous and corresponding reciprocation of said magnet means within said position cylinder;

said magnet means being operative to activate, in sequence, said first, second and third switch means as said magnet means reciprocates within said position cylinder in driven relation to said driver piston;

said compressor cylinder having an inlet valve and an exhaust valve, both of which valves are confluent with a common compresor cylinder head;

said expander cylinder having an inlet valve and an exhaust valve, both of which valves are confluent with a common expander cylinder head;

means for selectively opening and closing said inlet and exhaust valves;

a logic control unit conductively coupled to said first, second and third switch means;

said means for selectively opening and closing said inlets and exhaust valves being coupled in driven relation to said logic control unit so that said logic control unit determines the opening and closing of said inlet and exhaust valves based upon the position of said driver piston;

a first heat exchanger means having a first inlet confluent with boiled off cryogenic gases from a load and having a first outlet confluent with said compressor cylinder inlet valve;

a second heat exchanger means having a first inlet confluent with said compressor cylinder exhaust valve and a second inlet confluent with said expander cylinder exhaust valve;

said expander cylinder inlet valve being confluent with said compressor cylinder exhaust valve; and a motor driven external compressor means for driving said driver piston.

2. The apparatus of claim 1, wherein said second heat exchanger has a first outlet confluent with said first inlet, said first outlet being confluent with said expander cylinder inlet valve.

3. The apparatus of claim 2, wherein said second heat exchanger has a second outlet confluent with said second heat exchanger second inlet.

4. The apparatus of claim 3, further comprising a phase separator means confluent with said second outlet of said second heat exchanger.

5. The apparatus of claim 4, wherein said second heat exchanger has a third inlet, wherein said phase separator means has a gas region and a liquid region therein, and wherein said third inlet is confluent with said gas region of said phase separator means.

6. The apparatus of claim 5, wherein the liquid region of said phase separator means contains cryogenic liquid cooled by the apparatus and wherein a phase separator outlet conduit provides fluid communication from said liquid region to said cryogenic load.

7. The apparatus of claim 6, further comprising a first Joules-Thompson valve disposed between said second heat exchanger second outlet and said phase separator means.

8. The apparatus of claim 7, further comprising a second Joules-Thompson valve disposed between said outlet conduit of said phase separator means and the inlet valve of said compressor cylinder.

9. The apparatus of claim 8, wherein said first heat exchanger means includes a second inlet confluent with a source of make-up cryogenic fluid.

10. The apparatus of claim 9, wherein said first heat exchanger further includes a third inlet, wherein said second heat exchanger further includes a third outlet, and wherein said third outlet of said second heat exchanger is confluent with the third inlet of said first heat exchanger.

11. The apparatus of claim 10, further comprising a cool down valve disposed between said second heat exchanger third outlet and said first heat exchanger third inlet.

12. The apparatus of claim 11, further comprising a bypass valve disposed between said first heat exchanger outlet and the first inlet of said second heat exchanger.

13. A cryogenic refrigeration apparatus, comprising:

a compressor and an expander;

a common driver means for driving said compressor and expander;

a magnetically-activated first switch means that is activated when said driver means is in a bottom dead center position;

a magnetically-activated third switch means that is activated when said driver means is in a top dead center position;

a magnetically-activated second switch means that is activated when said driver means has traveled forty percent of the distance between its bottom dead center position toward its top dead center position;

a logic control unit that receives input information from said first, second and third switch means;

said compressor and expander having inlet and outlet valve means;

said logic control means selectively opening and closing said valve means in a predetermined sequence dependent upon the instantaneous position of said driver means;

a first and second heat exchanger means;

said compressor positioned in confluent relation between an outlet of said first heat exchanger means and an inlet of said second heat exchanger means; and said expander being positioned in confluent relation between a first outlet of said second heat exchanger means and a second inlet of said second heat exchanger means.

14. The apparatus of claim 13, wherein said first heat exchanger means includes a first inlet confluent with boiled off cryogenic gases from a cryogenic load, a first outlet confluent with an inlet valve means fo said compressor, a second inlet confluent with a source of make-up cryogenic fluid, and a third inlet confluent with a third outlet of said second heat exchanger means.

15. The apparatus of claim 13, wherein said second heat exchanger means includes a first inlet confluent with an exhaust valve means of said compressor, a first outlet confluent with an inlet of said expander, a second inlet confluent with an exhaust valve of said expander, a second outlet confluent with a phase separator means inlet, a third inlet confluent with a phase separator gas outlet, and a third outlet confluent with a third inlet of said first heat exchanger means.

16. The apparatus of claim 15, further comprising a first Joules-Thompson valve positioned between said second outlet of said second heat exchanger means and said phase separator inlet.

17. The apparats of claim 16, further comprising a second Joules-Thompson valve positioned between a liquid outlet of said phase separator means and the inlet valve means of said compressor.

18. The apparatus of claim 17, further comprising a bypass valve positioned in bypassing relation to said compressor, said bypass valve providing direct fluid communication between an outlet of said first heat exhanger means and the first inlet of said second heat exchanger means.

19. The apparatus of claim 18, further comprising a cool down valve positioned between the third outlet of said second heat exchanger means and the third inlet of said first heat exchanger means.

20. The apparatus of claim 13, further comprising an external compressor means for driving said common driver means.

* * * * *